US008353576B2

(12) United States Patent
Yamamoto et al.

(10) Patent No.: US 8,353,576 B2
(45) Date of Patent: Jan. 15, 2013

(54) LIQUID DISCHARGE HEAD AND ELECTRIC WIRING SUBSTRATE

(75) Inventors: Akira Yamamoto, Yokohama (JP); Toshiaki Hirosawa, Hiratsuka (JP); Hiroki Tajima, Yokohama (JP); Kyota Miyazaki, Tama (JP)

(73) Assignee: Canon Kabushiki Kaisha, Tokyo (JP)

( * ) Notice: Subject to any disclaimer, the term of this patent is extended or adjusted under 35 U.S.C. 154(b) by 84 days.

(21) Appl. No.: 13/104,746

(22) Filed: May 10, 2011

(65) Prior Publication Data

US 2011/0279548 A1 Nov. 17, 2011

(30) Foreign Application Priority Data

May 14, 2010 (JP) ..... 2010-112366

(51) Int. Cl.
*B41J 2/14* (2006.01)
*B41J 2/16* (2006.01)

(52) U.S. Cl. ..... 347/50; 347/49; 347/58

(58) Field of Classification Search ..... 347/20, 347/50, 56–59

See application file for complete search history.

(56) References Cited

U.S. PATENT DOCUMENTS 4,350,448 A * 9/1982 Hanagata et al. ..... 400/120.16
7,699,438 B2 * 4/2010 Kubo ..... 347/50
2006/0044355 A1 3/2006 Ito

* cited by examiner

*Primary Examiner* — Juanita D Jackson
(74) *Attorney, Agent, or Firm* — Canon USA Inc. IP Division

(57) ABSTRACT

A liquid discharge head includes a recording element substrate having a plurality of discharge ports for discharging liquid, and a plurality of recording elements for generating energy to discharge liquid, and an electric wiring substrate electrically connecting the recording element substrate and a driving circuit substrate having a circuit for driving the plurality of recording elements, the electric wiring substrate having a plurality of first electrical contact groups including a plurality of electrical contacts, for electrically connecting with the driving circuit substrate, provided along a disposed direction in which the plurality of discharge ports are disposed. The plurality of first electrical contact groups are detachably attached to a plurality of second electrical contact groups electrically connected with the driving circuit substrate, such that adjacent first electrical contact groups do not overlap each other in the disposed direction and in a direction orthogonal to the disposed direction.

11 Claims, 14 Drawing Sheets

LIQUID DISCHARGE HEAD AND ELECTRIC WIRING SUBSTRATE

BACKGROUND OF THE INVENTION

1. Field of the Invention

The present invention relates to a liquid discharge head that discharges a liquid, and an electric wiring substrate to be used for the liquid discharge head.

2. Description of the Related Art

A typical inkjet recording head (hereinafter, also referred to as a "recording head") represented by a liquid discharge head that discharges a liquid, includes a recording element substrate comprising a discharge port that discharges a liquid and a recording element that generates energy for discharging an ink from the discharge port. Further, the recording head includes an electric wiring substrate electrically connected with a recording element substrate, for supplying power from the outside to the recording element and sending a signal for driving the recording element.

In this case, when a number of signals for driving the recording element substrate is increased to improve an image quality, then a number of wirings within the electric wiring substrate is increased. In addition, a full-line type recording head having a print width comparable with a width of a recording medium, as discussed in US Patent Application Publication No. 2006/0044355, may have an increased number of the recording element substrates, in order to adapt to the print width. Also in such a case, a number of the wirings within the electric wiring substrate is increased.

As a number the wirings is increased in this way, a number of electrical contacts with the outside provided in the electric wiring substrate is increased. In a case where these are integrated into a single connector, when the connector (electrical contact group) is attached or detached, an inserting/withdrawing force required for attaching/detaching it becomes large, and there is a risk that a load applied on the recording head may become large. Thus, the invention discussed in US Patent Application Publication No. 2006/0044355, has a configuration such that connectors (male connector 61 of sub-substrate 60) provided with a plurality of electrical contacts with the outside of the electric wiring substrate, are divided into two or more, and provided in a longitudinal direction of the recording head, in other words, along a disposed direction in which a plurality of the discharge ports are disposed.

In an electric wiring substrate having a plurality of connectors, when a plurality of connectors is arranged within a narrow region, adjacent connectors are arranged to come close to each other. As a result, a space to be used when connectors are attached or detached will be limited, and there is a risk that the workability may be degraded. In order to prevent degradation of the workability, it is desirable to arrange adjacent connectors apart enough from each other in the direction of the disposed discharge ports, and to secure a space where the connectors are attached or detached. However, in this case, it is possible that a width in the disposed direction of the discharge ports in a connector region where a plurality of connectors of the electric wiring substrate is provided, may become large.

SUMMARY OF THE INVENTION

The present invention is directed to providing a liquid discharge head and an electric wiring substrate in which a width in a disposed direction of a plurality of discharge ports, in a region where a plurality of electrical contact groups is provided, of the electric wiring substrate can be made small, and workability at the time attachment/detachment of each electrical contact group can be maintained and improved.

According to an aspect of the present invention, a liquid discharge head includes a recording element substrate having a plurality of discharge ports for discharging liquid, and a plurality of recording elements generating energy to discharge liquid from the plurality of discharge ports, and an electric wiring substrate electrically connecting the recording element substrate and a driving circuit substrate having a circuit for driving the plurality of recording elements, the electric wiring substrate having a plurality of first electrical contact groups including a plurality of electrical contacts, for electrically connecting with the driving circuit substrate, provided along a disposed direction in which the plurality of discharge ports are disposed. The plurality of first electrical contact groups are detachably attached to a plurality of second electrical contact groups electrically connected with the driving circuit substrate, such that adjacent first electrical contact groups of the plurality of first electrical contact groups, do not overlap each other in the disposed direction and in a direction orthogonal to the disposed direction.

According to the present invention, a liquid discharge head and an electric wiring substrate can be provided wherein a width in a disposed direction of a plurality of the discharge ports, in a region where a plurality of electrical contact groups of the electric wiring substrate is provided, can be made small, and a workability of each electrical contact group at the time attachment/detachment can be maintained and improved.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 1A, 1B, and 1C are explanatory views of a recording head to which the present invention can be applied, wherein FIG. 1A is a general perspective view of the recording head, FIG. 1B is underneath view of the recording head, and FIG. 1C is an exploded perspective views of the recording head.

FIGS. 3A and 3B are explanatory views of a recording element substrate, wherein FIG. 3A is a general perspective view of the recording element substrate, and FIG. 3B is a cross-sectional view taken along a line A-A in FIG. 3A.

FIGS. 4A, 4B, and 4C are explanatory views of a base plate, wherein FIG. 4A is a general perspective view including a surface on which the recording element substrate is arranged, FIG. 4B is a general perspective view including a surface on which the ink inlets and the ink outlets are provided, and FIG. 4C is a plan view indicating an internal ink flow path by making it transparent, as viewed form a surface on which the recording element substrate is arranged.

FIGS. 5A and 5B are explanatory views of an electric wiring substrate, wherein FIG. 5A is a general perspective view of the electric wiring substrate, and FIG. 5B is a schematic view of a wiring layout.

FIGS. 11A and 11B illustrate the recording apparatus when the recording head is mounted to which the present invention can be applied, wherein FIG. 11A is a plan view in FIG. 9 as viewed from "X" direction, and FIG. 11B is a plan view including B-B cross-section in FIG. 11A.

DESCRIPTION OF THE EMBODIMENTS

Various exemplary embodiments, features, and aspects of the invention will be described in detail below with reference to the drawings.

The typical inkjet recording head (hereinafter, referred to as a "recording apparatus") represented by the liquid discharge head to which the present invention can be applied will be described by way of example. FIGS. 1A, 1B, and 1C through FIGS. 11A and 11B are explanatory views of configurations of the recording head, and the inkjet recording apparatus on which the recording head is mounted.

FIG. 1 illustrates a configuration of a recording head 100 to which the present invention can be applied. The recording head 100 is a full-line type recording head 100 wherein a recording element substrates 1100 having discharge ports are arranged over a range corresponding to a maximum width of a recording sheet such as paper assumed to be used, and thus recording can be performed at a high speed, without the need to move the recording head 100 to scan the recording sheet.

Figure 1A:
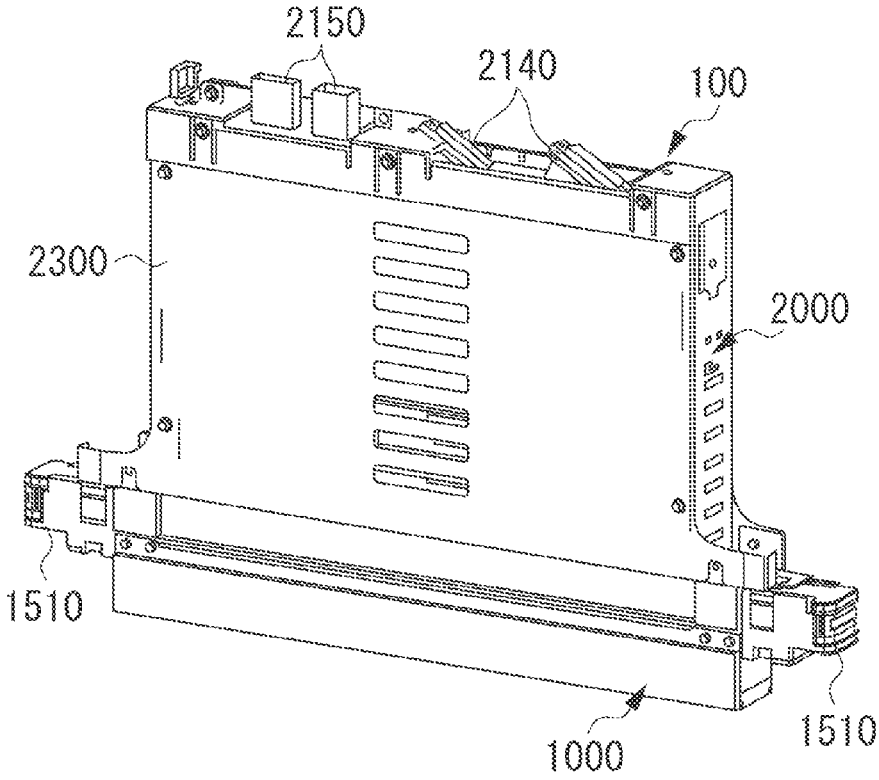
Figure 1B:
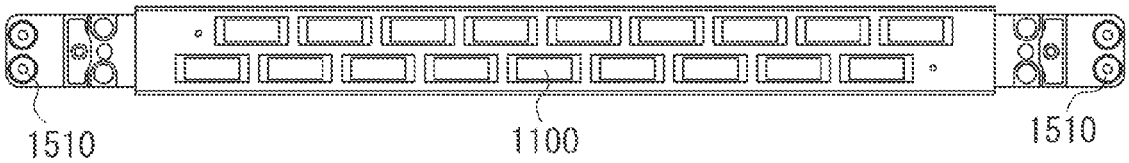
Figure 1C:
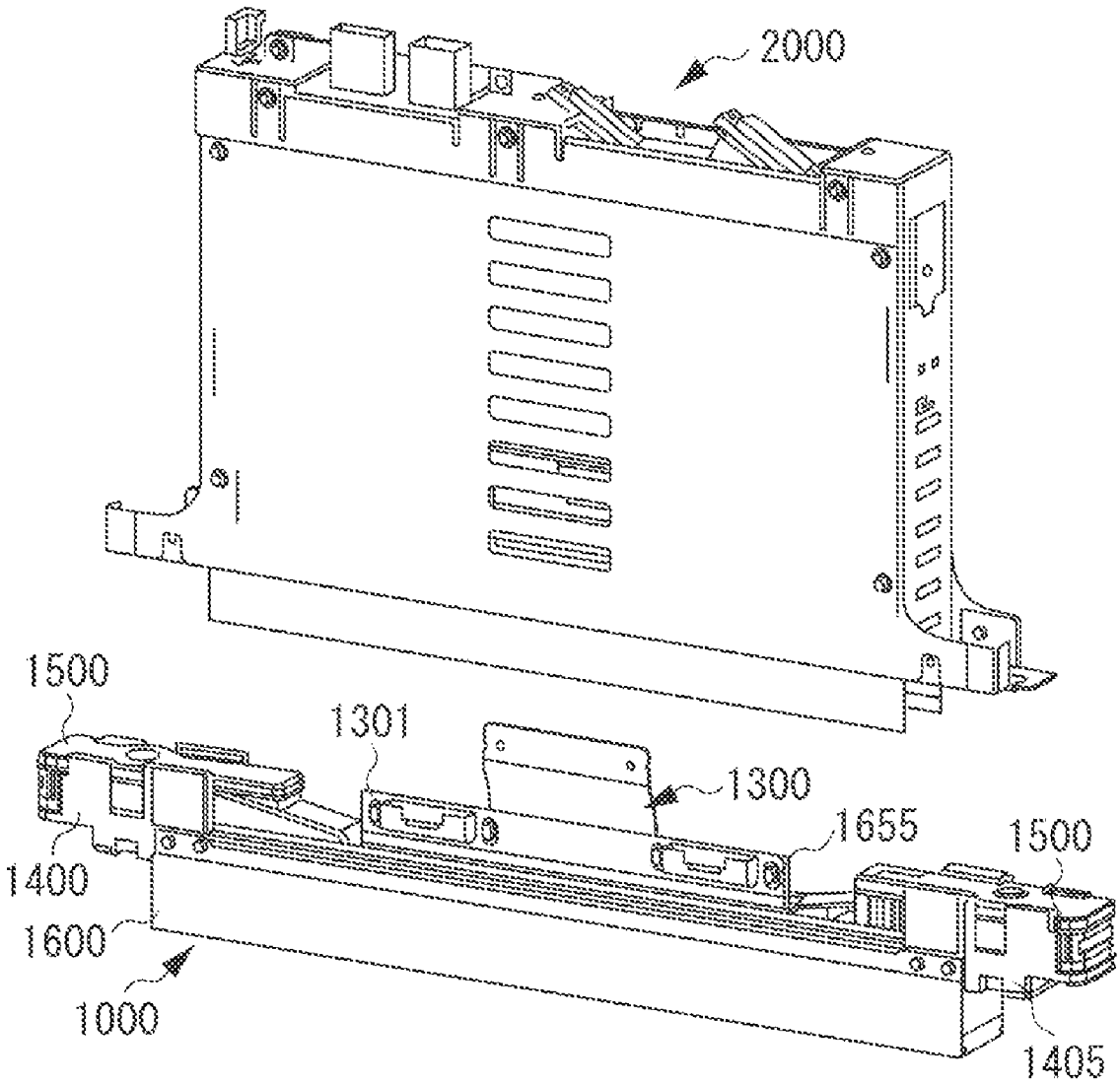
Figure 2:
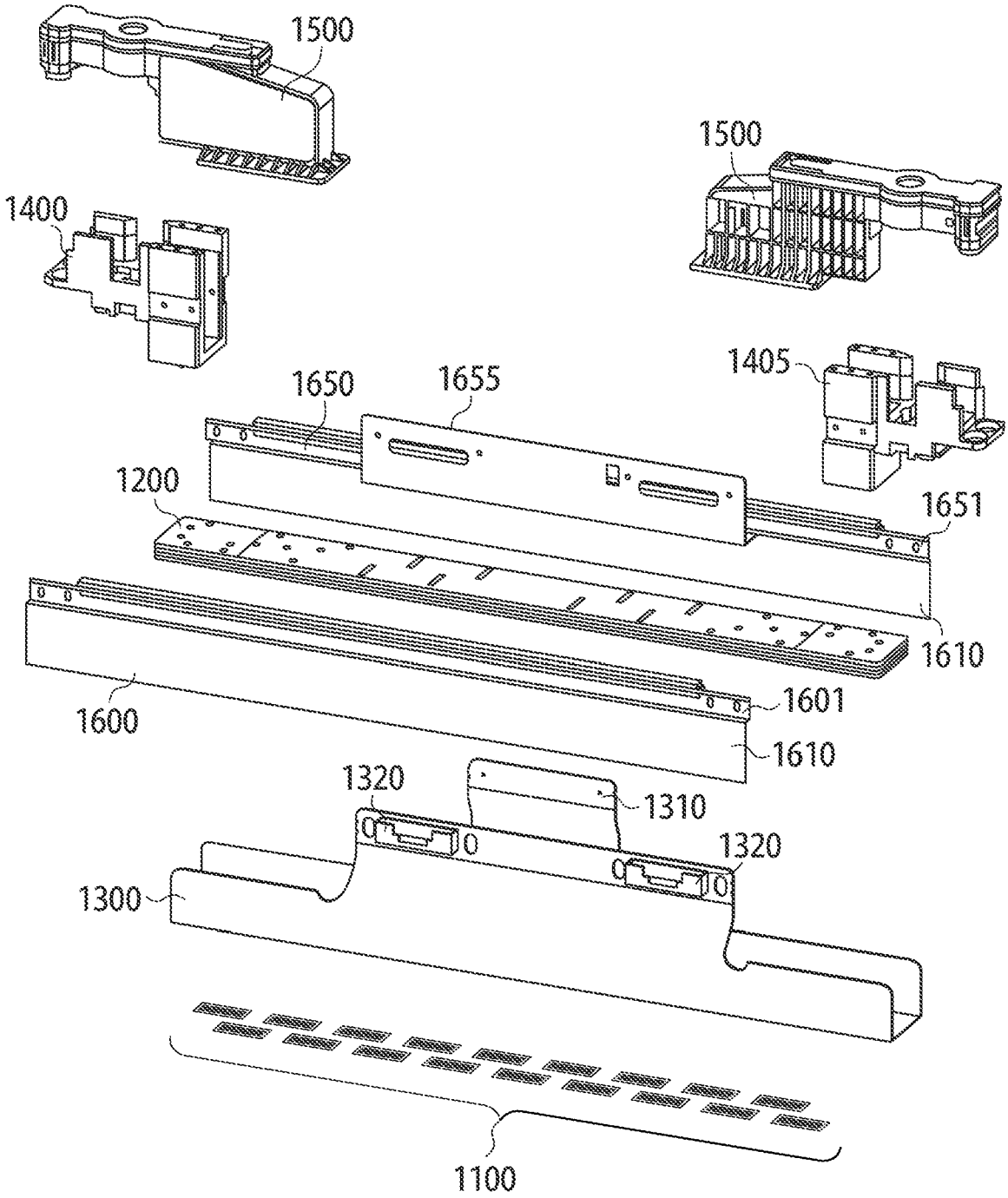
FIG. 2 is an exploded perspective view of a recording element unit.
Figure 3A:
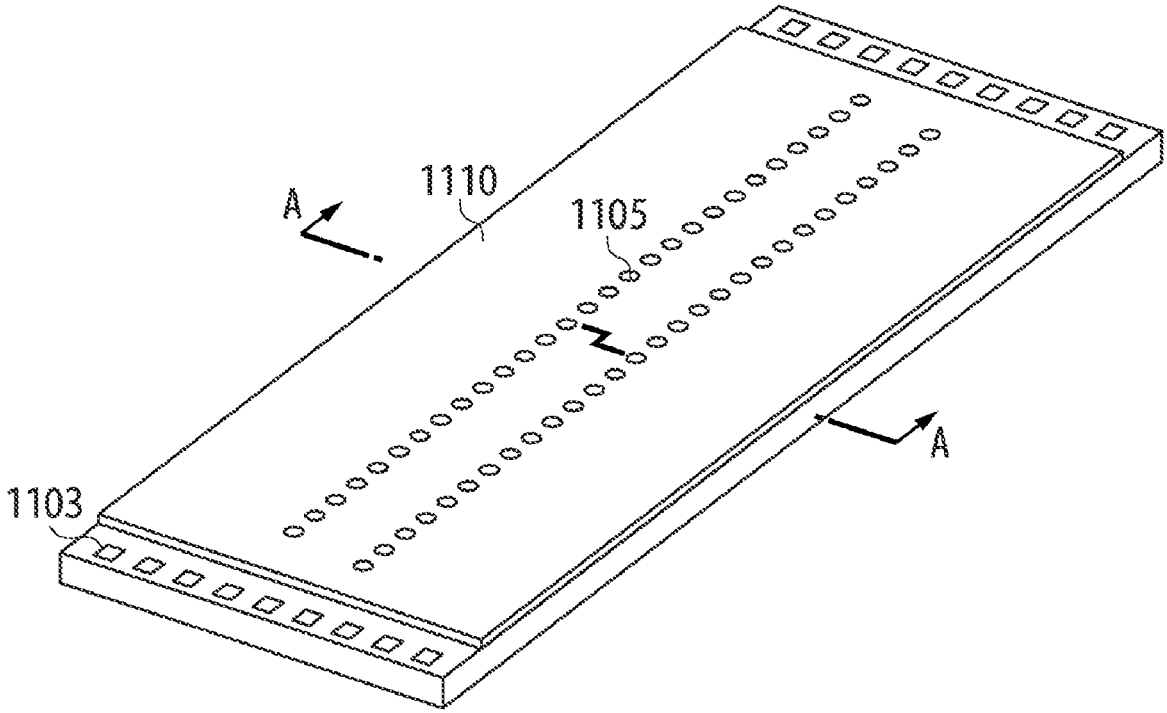
Figure 3B:
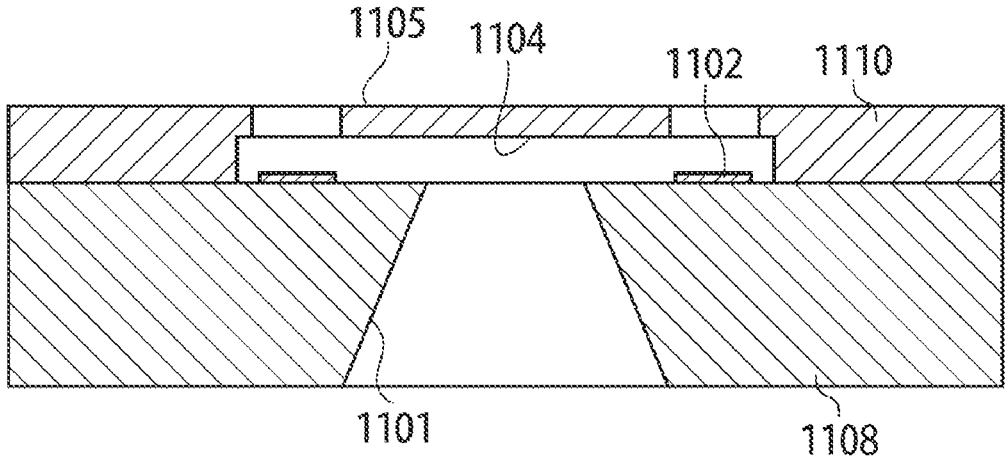

As illustrated in FIG. 1C, the recording head 100 includes a recording element unit 1000 and a driving circuit substrate unit 2000. The recording element unit 1000 and the driving circuit substrate unit 2000 are combined detachably with each other mechanically and electrically FIG. 2 illustrates an exploded perspective view of the recording element unit 1000. The recording element unit 1000 includes a plurality of recording element substrates 1100, a base plate 1200, two supporting members 1400 and 1405, two ink supply members 1500, an electric wiring substrate 1300, and two side plate assemblies 1600 and 1650.

The plurality of the recording element substrates 1100 are disposed accurately in a staggered pattern in a longitudinal direction of the base plate 1200, on the base plate 1200. The two supporting members 1400 and 1405 and the two inks supply members 1500 are fixed at both ends in the longitudinal direction of the base plate 1200. The electric wiring substrate 1300 is bonded and fixed to the base plate 1200, and both ends in a lateral direction of the electric wiring substrate 1300 are bent.

Next, a configuration of the recording element unit 1000 will be described in more detail. First, a configuration of the recording element substrate 1100 is described with reference to FIGS. 3A and 3B. The recording element substrate 1100 is constituted by a silicon substrate 1108 and a discharge port plate 1110.

A thickness of a silicon substrate 1108 is approximately, e.g., 0.5 to 1 mm. In the silicon substrate 1108, a long groove-shaped ink supply port 1101 extending in a longitudinal direction of the silicon substrate 1108 is formed. On both sides of the ink supply port 1101, electrothermal conversion elements 1102 such as a heater serving as a recording element that generates energy for discharging the ink are arrayed in a staggered pattern in a line. The electrothermal conversion elements 1102, and electric wirings (not illustrated) such as aluminum electrically connected to the electrothermal conversion elements 1102 are formed by film-forming technology. Further, electrodes 1103 electrically connected to the electric wiring substrate 1300 are provided at both ends in the longitudinal direction of the recording element substrate 1100.

On the silicon substrate 1108, the discharge port plate 1110 formed of resin material is provided. On the discharge port plate 1110, the ink flow paths 1104 and the discharge ports 1105 corresponding to the electrothermal conversion elements 1102 are formed by photolithography technology. The discharge ports 1105 are provided to face the electrothermal conversion elements 1102. More specifically, the discharge ports 1105 are disposed along the longitudinal direction of the recording element substrate 1100. By producing air bubbles by driving the electrothermal conversion elements 1102, the ink supplied from the ink supply ports 1101 is discharged from the discharge ports 1105.

In the present exemplary embodiment, the recording element substrates 1100 are arranged facing the base plate 1200 so that a plurality of the discharge ports 1105 are disposed along a longitudinal direction of the recording head 100, in other words, a longitudinal direction of the base plate 1200. Therefore, in the present exemplary embodiment, a longitudinal direction of the recording head 100 and a disposed direction of a plurality of the discharge ports 1105 correspond with each other.

Figure 4A:
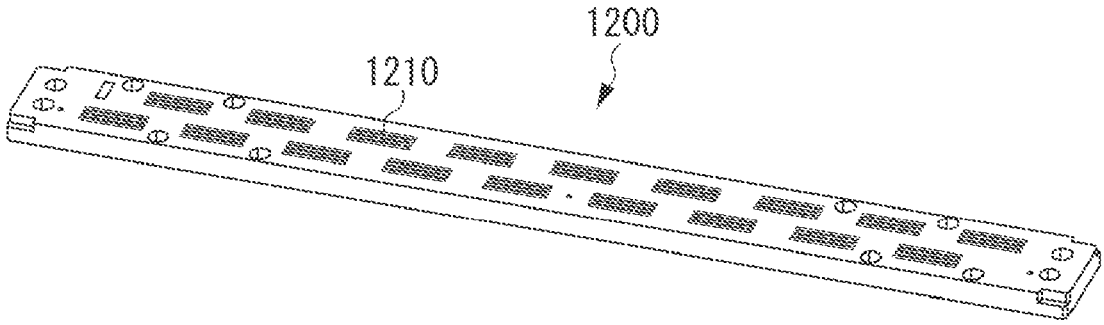
Figure 4B:
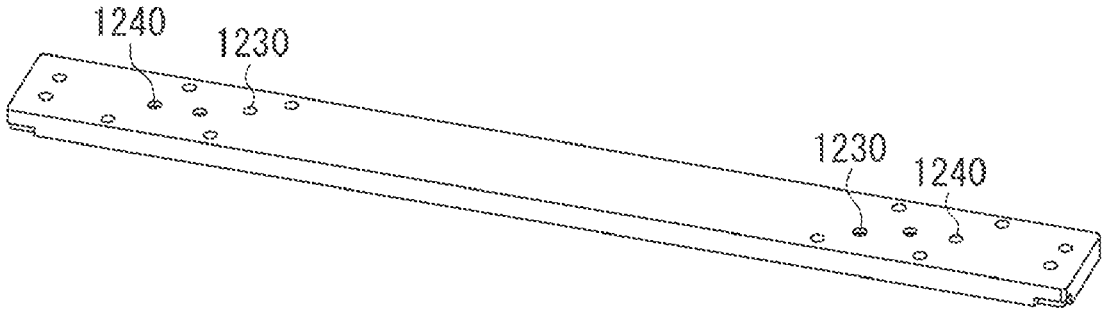
Figure 4C:
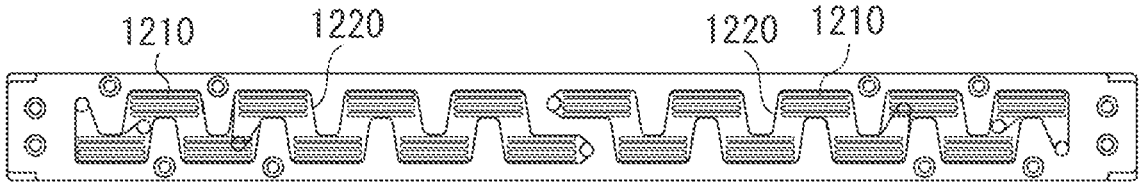

Next, a configuration of the base plate 1200 is described with reference to FIGS. 4A to 4C. The base plate 1200 is formed by laminating and burning a plurality of alumina green sheets formed of aluminum oxide ($Al_2O_3$; hereinafter, referred to as an alumina). A thickness of the alumina green sheets is approximately, e.g., 0.5 to 1 mm, and a thickness of the base plate 1200 formed by laminating them is approximately 10 mm. On the base plate 1200, ink supply slits 1210 for supplying inks to the ink supply ports 1101 of the recording element substrate 1100, and ink flow paths 1220 for supplying the ink from an ink tank (not illustrated) to the ink supply slits 1210 are formed.

In the present exemplary embodiment, aluminum oxide ($Al_2O_3$) is used as a material for the base plate 1200, but the material is not limited to this. It is only necessary for the material of the base plate 1200 to have a coefficient of linear expansion showing the same degree as a material of a member of the recording element substrate 1100 which comes into contact with the base plate 1200, and to have a coefficient of thermal conductivity showing the same degree as or greater than that of the material. Examples of the materials of the base plate 1200 include silicon (Si), aluminum nitride (AlN), zirconia ($ZrO_2$), silicon nitride ($Si_3N_4$), silicon carbide (SiC), and molybdenum (Mo), and tungsten (W).

Figure 5A:
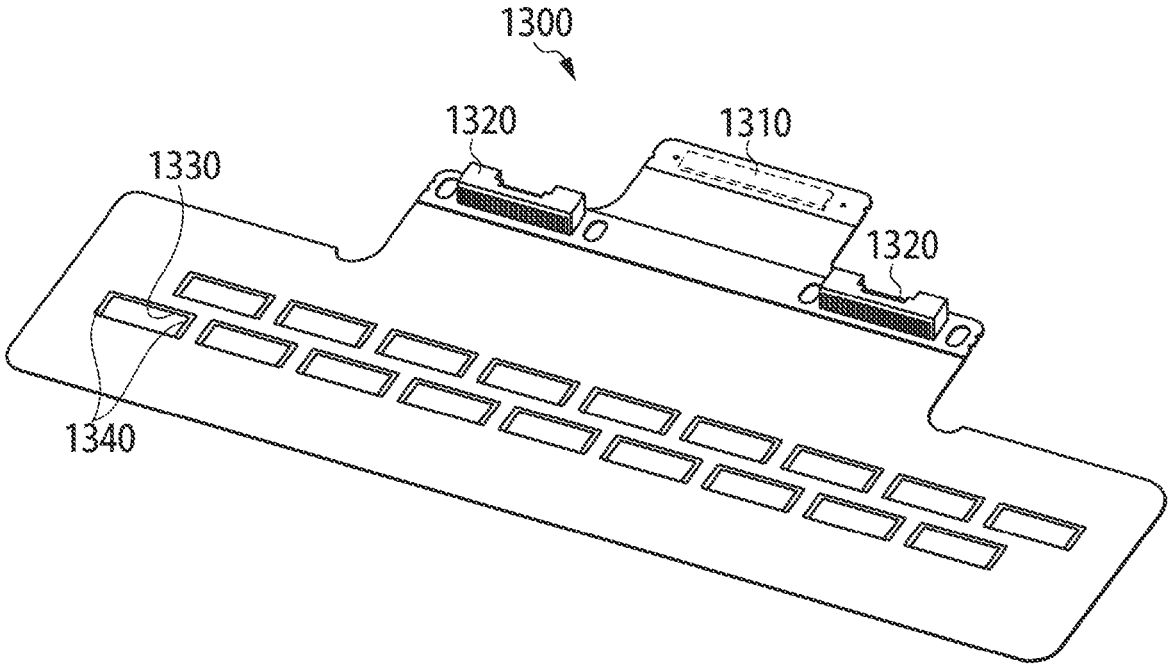

FIG. 5A illustrates a configuration of the electric wiring substrate 1300. The electric wiring substrate 1300 is a member for supplying signals for driving the electrothermal conversion elements 1102 sent from the recording apparatus 3000 (see FIG. 10), and electric power for driving the electrothermal conversion elements 1102, to the recording element substrates 1100. The electric wiring substrate 1300 is a flexible wiring substrate in which wiring patterns are formed on a resin film. The electric wiring substrate 1300 has a plurality of opening portions 1330 for incorporating the recording element substrates 1100 therein. Electrode terminals 1340 corresponding to electrodes 1103 of the recording element substrates 1100 are formed at both ends of the plurality of opening portions 1330. The electric wiring substrate 1300 is bonded and fixed to a surface on which the ink supply slits 1210 are formed, of the base plate 1200.

Inside the electric wiring substrate 1300, signal wirings 1311 for transmitting signals that drive the electrothermal conversion elements 1102, and power supply wirings 1321 for supplying electric power for the electrothermal conversion element 1102 are disposed. On one end of the electric wiring substrate 1300, a signal wiring connector 1310 (electrical contact group for signal) is formed wherein a plurality of electrical contacts for signal electrically connecting the outside with the signal wirings 1311 are disposed along the disposed direction in which a plurality of the discharge ports 1105 are disposed. Similarly, on one end of the electric wiring substrate 1300, power supply wiring connectors 1320 (electrical contact group for power supply) are formed wherein a plurality of electrical contacts for power supply electrically connecting the outside with the power supply wirings 1321 are disposed along the disposed direction of a plurality of the discharge ports 1105. In this case, connectors for electrical connection with the driving circuit substrate 2100, provided in the electric wiring substrate 1300 (in the present exemplary embodiment, the signal wiring connector 1310 and the power supply wiring connectors 1320) is referred to as a first electrical contact group. An arrangement of the wirings and connectors provided in the electric wiring substrate 1300 will be described below in detail.

The electric wiring substrate 1300 and the electrothermal conversion elements 1102 are electrically connected, for example, by joining the electrodes 1103 of the recording element substrates 1100 and the electrode terminals 1340 of the electric wiring substrate 1300 by wire bonding technology using gold wires (not illustrated). Then, the electrodes 1103 of the recording element substrates 1100, and the electrode terminals 1340 of the electric wiring substrate 1300, and wires are covered with sealing compound, and protected from corrosions caused by inks or external shocks.

FIG. 6 illustrates a configuration of a supporting member A 1400 and a supporting member B 1405. The two supporting members 1400 and 1405 hold and fix the recording head 100, and are fixed each at both ends in the longitudinal direction of the base plate 1200. In each of the supporting members 1400 and 1405, a positioning hole A 1410 and a positioning hole B 1415 are formed which fit into positioning pins 3430 (see FIGS. 11A and 11B) provided in the recording apparatus 3000, when the recording head 100 is mounted onto the recording apparatus 3000. The two positioning holes 1410 and 1415 are used to mount the recording head 100 at a correct position in a lateral direction ("X" direction illustrated in FIG. 9) of the recording head 100 and a longitudinal direction ("Y" direction illustrated in FIG. 9) of the recording head 100. The positioning hole A 1410 of the supporting member A 1400 is a circular hole, and the positioning hole B 1415 of the supporting member B 1405 is a long hole. When the recording head 100 is mounted onto the recording apparatus 3000, the recording head 100 abuts on head holders 3400 (see FIGS. 11A and 11B) which support the recording head 100. Positioning portions 1430 are formed at locations where the recording head 100 abuts on head holders 3400. The positioning portions 1430 are members for keeping an interval constant between the recording sheet and a surface of a side on which the discharge ports 1105 of the recording element substrates 1100 are provided.

Furthermore, the supporting members 1400 and 1405 are shaped such that the ink supply members 1500 can fit thereinto, and only connection portions 1510 of the ink supply members 1500 come into contact with the recording apparatus 3000 (see FIG. 11). Accordingly, a risk of deformation of the ink supply members 1500 is reduced, which may be generated by external force being exerted on the ink supply members 1500, when the recording head 100 is attached to or detached from the recording apparatus 3000.

A configuration of the side plate assembly A 1600 and the side plate assembly B 1650 will be described with reference to FIG. 2. The two side plate assemblies 1600 and 1650 are thin plate-like members covering the side surface of the recording head 100. The side plate assembly A 1600 is constructed such that a plate-like side-plate 1610 is attached to a rod-like base bar A 1601. The side plate assembly B 1650 is constructed such that the plate-like side-plate 1610 is attached to the rod-like base bar B 1651. The plate-like wiring substrate fixing portion 1655 for fixing the peripheries of the power source connecting portions 1320 of the electric wiring substrate 1300 is integrally formed with the rod-like base bar B 1651. The two side plate assemblies 1600 and 1650 are provided to cover a surface of a portion disposed on a side surface of the electric wiring substrate 1300 in a longitudinal direction of the recording element unit 1000, and are fixed to the two supporting members 1400 and 1405.

Figure 7:
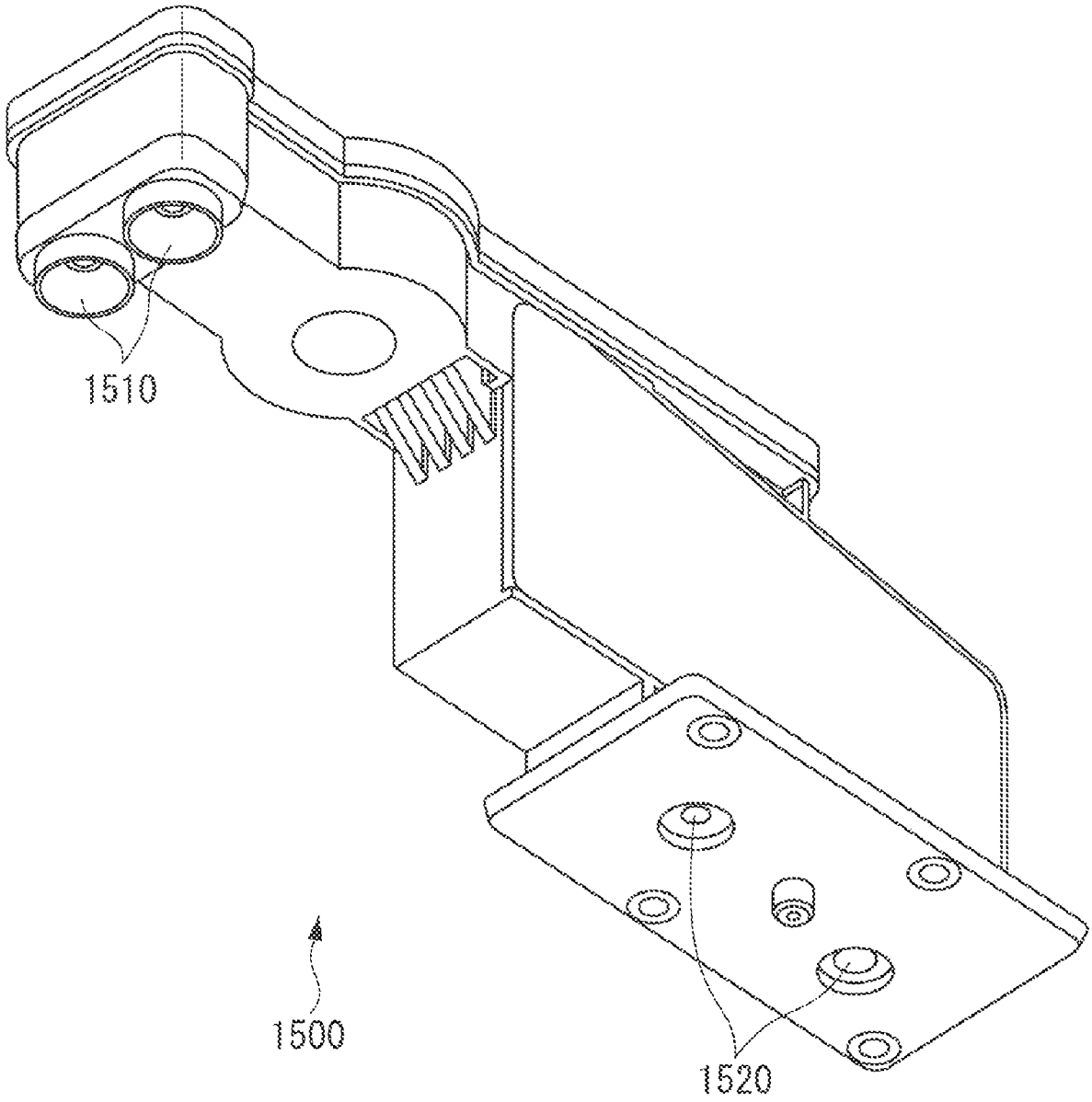
FIG. 7 is a general perspective view illustrating an ink supply member.

FIG. 7 illustrates a configuration of the ink supply members 1500. The ink supply members 1500 are connected to the connecting units 3410 (see FIG. 11A) on the recording apparatus 3000 side, and are members that supply inks from the recording apparatus 3000 to the recording element unit 1000. The ink supply members 1500 are formed of, e.g., resin materials, and are provided with two connecting portions 1510 connected to the recording apparatus 3000, and two opening portions 1520 connected to the base plate 1200. The two connecting portions 1510 and the two opening portions 1520 each are provided to circulate the ink between the recording apparatus 3000 and the recording element unit 1000. Inside the ink supply members 1500, the ink flow paths (not illustrated) which connect the connecting portions 1510 and the opening portions 1520 are provided, and filters (not illustrated) for removing foreign substances or air bubbles mixed into the ink are arranged at some midpoint in the ink flow paths. Then, joint rubbers for joining with ink supply pipes of the recording apparatus 3000 are attached to the connecting portions 1510, and the connecting portions 1510 are connected to the connecting units 3410 of the recording apparatus 3000. The ink supply members 1500 are positioned relative to the base plate 1200, so that the opening portions 1520 communicate with the ink inlets 1230 and the ink outlets 1240 (see FIG. 4) formed near the end portions of the base plate 1200.

Figure 8:
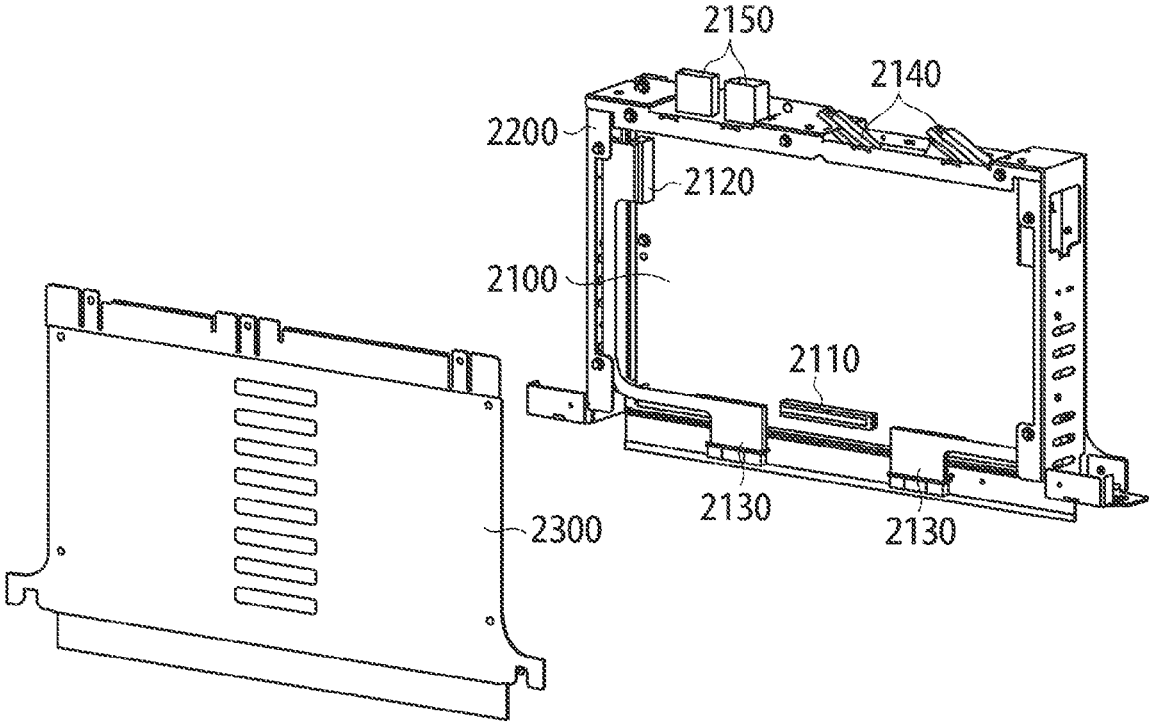
FIG. 8 is an exploded perspective view illustrating a driving circuit substrate unit.

FIG. 8 is a perspective view of a driving circuit substrate unit 2000, and illustrates a state where a cover 2300 is removed. Inside the driving circuit substrate unit 2000, a driving circuit substrate 2100 for controlling a drive of the recording head 100 is fixed to a substrate holder 2200.

In the driving circuit substrate 2100, a signal wiring connector 2140 and a power supply wiring connectors 2150 for electrically connecting the recording apparatus 3000 are provided. Further, a signal wiring connector 2110 and power supply wiring connectors 2120 for electrically connecting the recording element unit 1000 are provided.

In a driving control circuit provided in the driving circuit substrate 2100, driving control signals for driving the predetermined electrothermal conversion elements 1102 are generated, from signals input via the signal wiring connectors 2140 from the recording apparatus 3000. The driving control signals are sent to the recording element unit 1000 via the signal wiring connector 2110. Also, in the driving circuit substrate 2100, a voltage input via the power supply wiring connectors 2150 is converted into a voltage to be applied to the electrothermal conversion element 1102, and is sent to the recording element unit 1000 via the power supply wiring connectors 2120.

The driving circuit substrate unit 2000 is attached to a surface of a side opposite to the discharge surface on which the electrothermal conversion element 1102 of the recording element unit 1000 are provided. More specifically, the driving circuit substrate unit 2000 are held on the supporting members 1400 and 1405 provided on both ends in the longitudinal direction of the recording element unit 1000, and are screwed and fixed with head fixing bolts 1450 (see FIG. 11).

Figure 9:
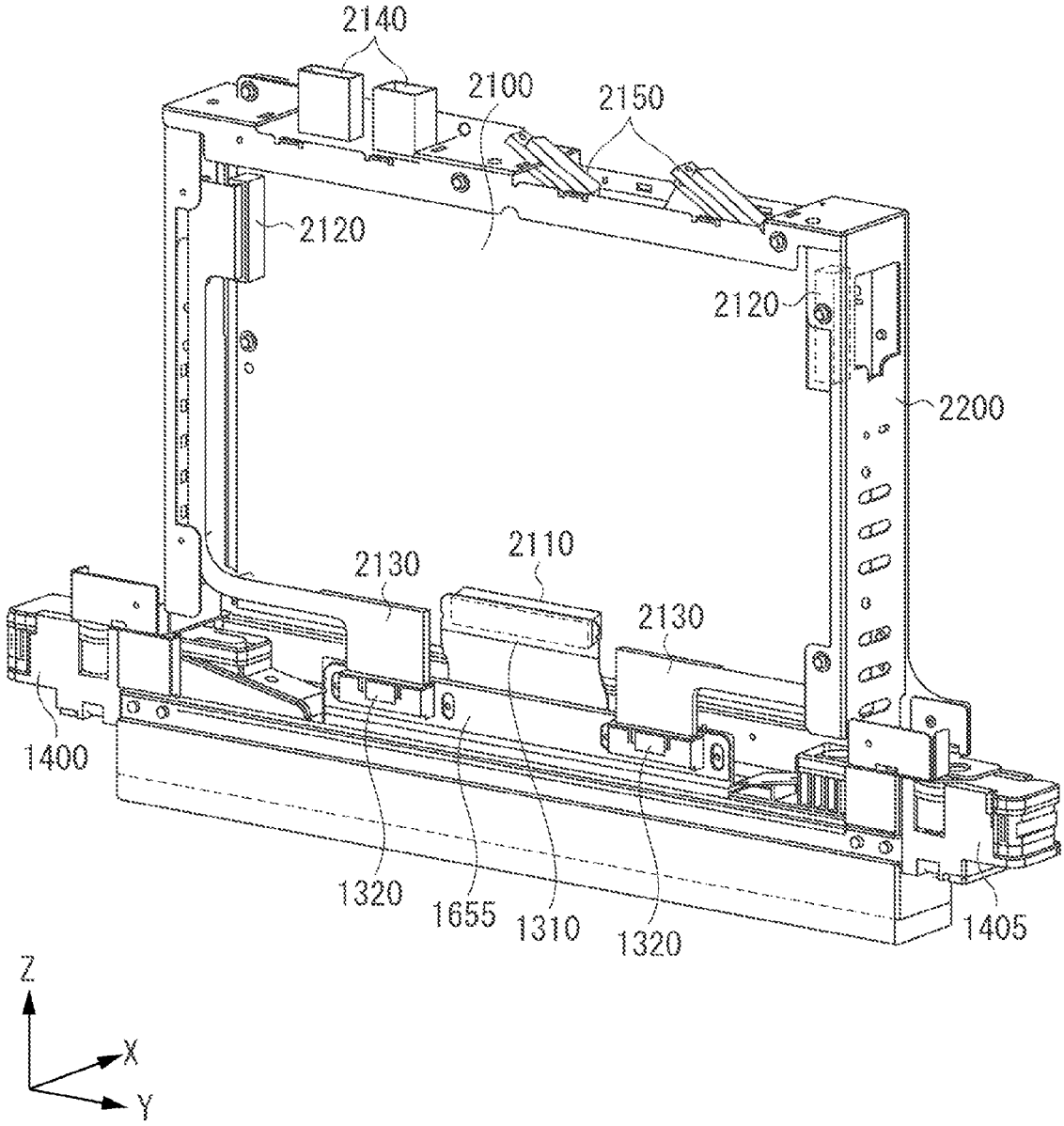
FIG. 9 is a perspective view illustrating a state where the recording element unit and the driving circuit substrate unit are combined.

The signal wiring connector 1310 of the electric wiring substrate 1300 is inserted to the signal wiring connector 2110 on a side of the driving circuit substrate 2100 having openings, thereby the recording element unit 1000 and the driving circuit substrate 2100 are electrically connected (see FIG. 9). In addition, the power supply wiring connectors 1320 on the electric wiring substrate 1300 side, and the power supply wiring connectors 2120 on the driving circuit substrate 2100 side are electrically connected via the wire harnesses 2130 as an electric wiring member, which is separate from the electric wiring substrate 1300. The power supply wiring connectors 1320 and 2120 have openings, and the wire harnesses 2130 are inserted into the both connectors. In this case, the signal wiring connector 1310 and the power supply wiring connectors 1320 of the electric wiring substrate 1300 are detachably attached to a second electrical contact group. More specifically, the second electrical contact group in the present exemplary embodiment is an end portion of the wire harnesses 2130 on a side where it is inserted into the signal wiring connector 2110, and the power supply wiring connectors 1320 on the driving circuit substrate 2100 side.

As illustrated in FIGS. 1A, 1B, and 1C, the recording element unit 1000 and the driving circuit substrate unit 2000 are combined, and there is little or no clearance between the recording element unit 1000 and the driving circuit substrate unit 2000.

Figure 10:
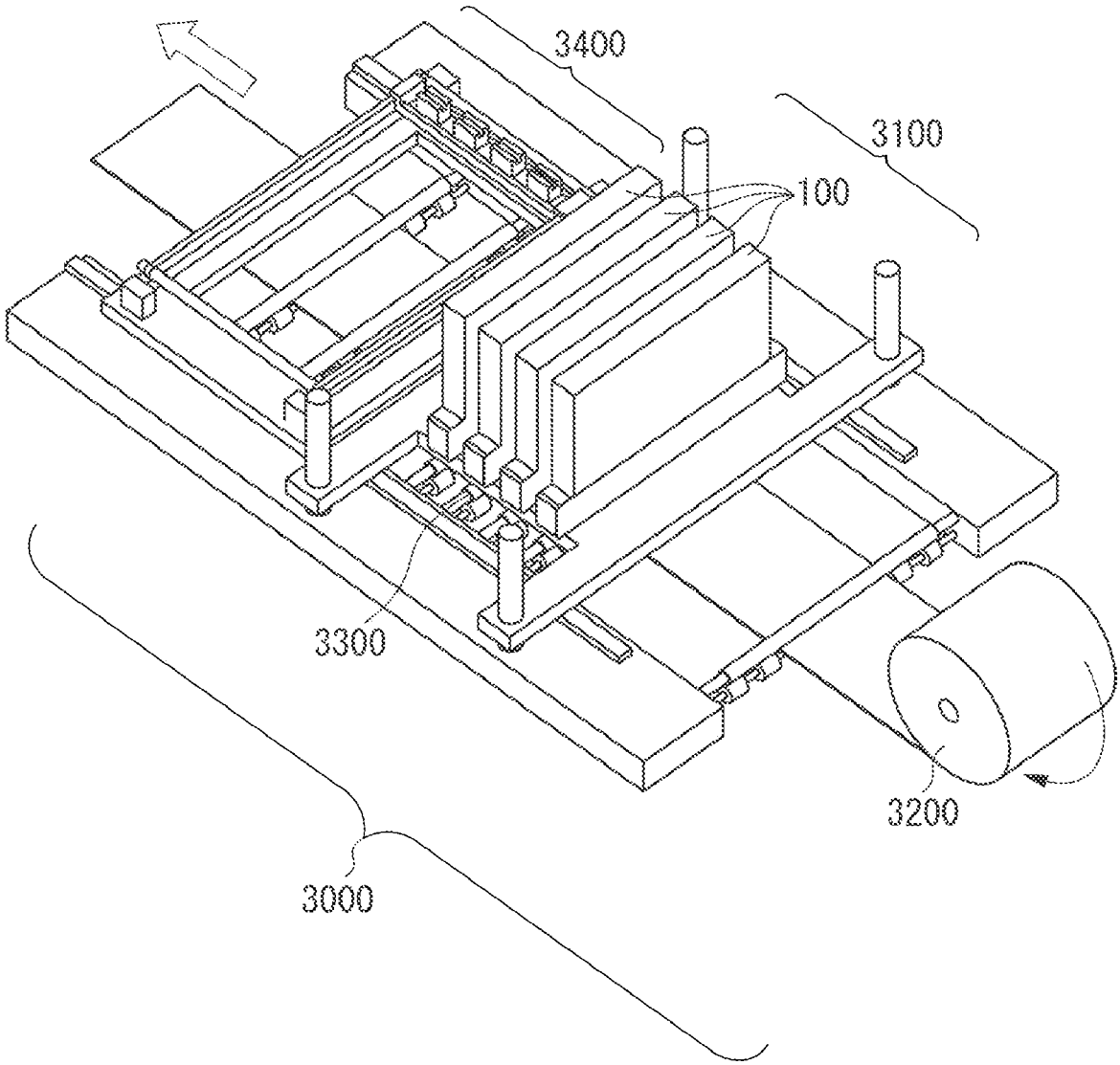
FIG. 10 is an explanatory view of a configuration of a recording apparatus.

FIG. 10 illustrates a configuration of a recording apparatus 3000 according to the exemplary embodiment of the present invention. The recording apparatus 3000 is a line printer that carries out recording, while continuously conveying a recording sheet 3200 as a recording medium in a conveyance direction ("X" direction illustrated in FIG. 9), using a long lengths of a full-line type recording head 100. The recording apparatus 3000 includes a holder (not illustrated) for holding the recording sheet 3200 wound in the form of roll, a conveying mechanism 3300 for conveying the recording sheet 3200 in the "X" direction at a predetermined speed, and a recording unit 3100 that performs recording on the recording sheet 3200 using the recording head 100. The recording sheet 3200 is not limited to a continuous roll sheet, and a cut sheet may be used. Moreover, the recording apparatus 3000 is provided with an ink tank (not illustrated) for containing an ink to be supplied to the recording head 100. In the recording unit 3100, a plurality of recording heads 100 each corresponding to different ink colors are provided in parallel. In the present exemplary embodiment, four recording heads 100 corresponding to four colors of cyan, magenta, yellow, black are available, but a number of colors and a type of colors are not limited to this.

Figure 11A:
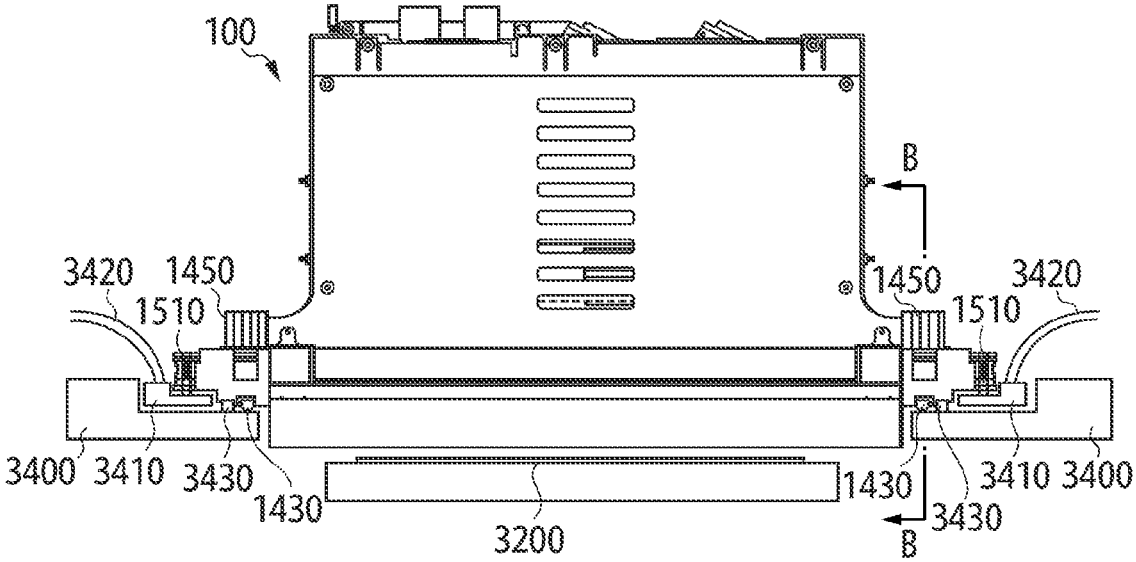
Figure 11B:
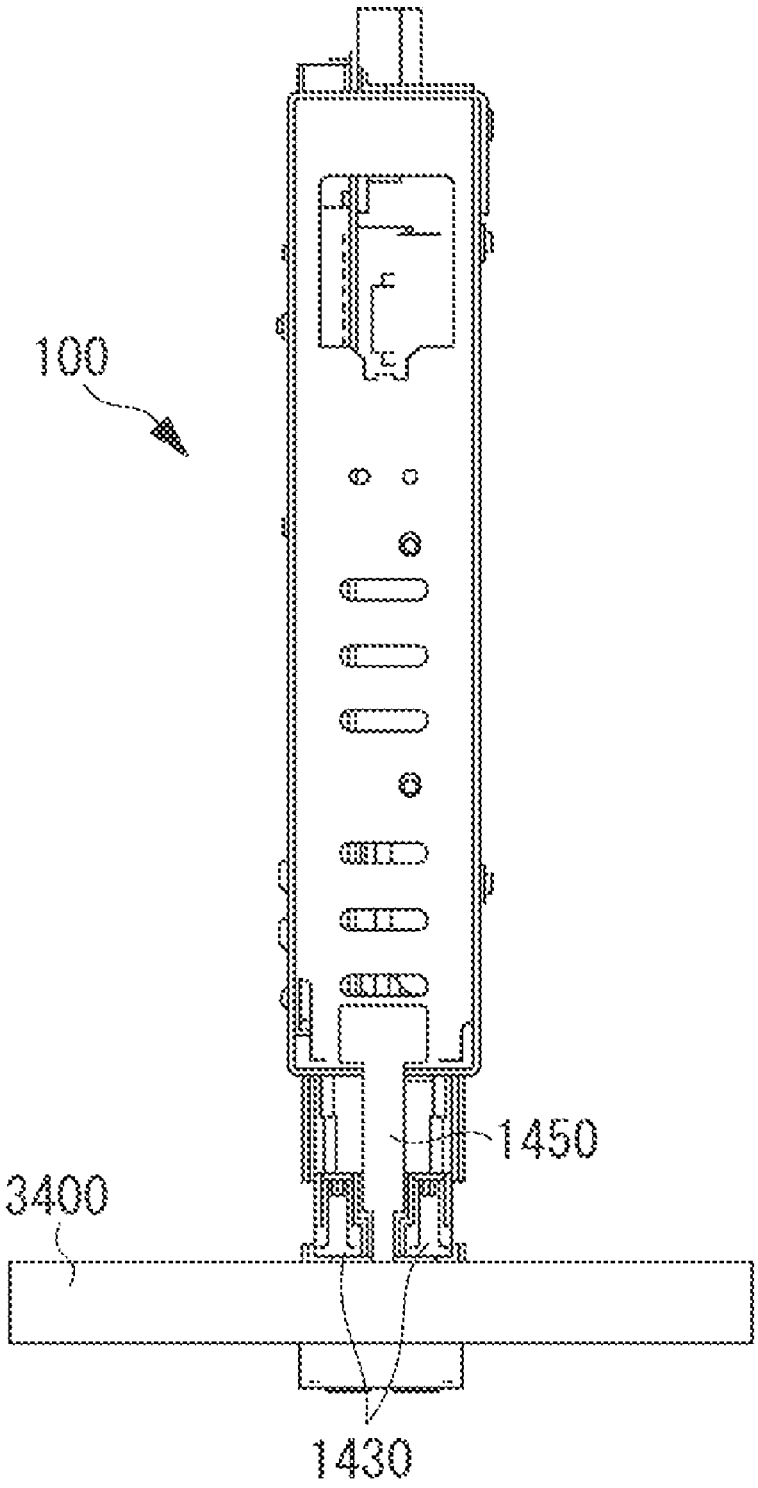

FIGS. 11A and 11B illustrate the recording head 100 mounted on the recording apparatus 3000. The connecting portions 1510 provided at both ends in the longitudinal direction of the recording head 100 are connected to the connecting units 3410 of the recording apparatus 3000. In the connected portions, the ink is transferred into the recording head 100, and transferred from the recording head 100. The inks for each color are supplied to the recording head 100 via ink tubes 3420 from the ink tanks.

The positioning holes 1410 and 1415 (see FIGS. 6A and 6B) arranged in the inner side in the longitudinal direction of the recording head 100 from the connecting portions 1510 fit into the positioning pins 3430 of the head holders 3400. The positioning portions 1430 of the recording head 100 abut on the head holders 3400, thereby positioning of the recording head 100 relative to the recording apparatus 3000 is carried out. The supporting members 1400 and 1405 provided at the both ends of the recording head 100 are fixed and held to the recording apparatus 3000 by head fixing bolts 1450.

A configuration of an electrical connection unit between the recording element unit 1000 and the driving circuit substrate unit 2000 which is feature part of the present invention will be described. A connector region 1301 of the electric wiring substrate 1300 side is a region where the signal wiring connector 1310 and the power supply wiring connectors 1320, in the electric wiring substrate 1300 are provided, and indicates a region surrounded by short dashed lines in FIG. 5B.

Figure 5B:
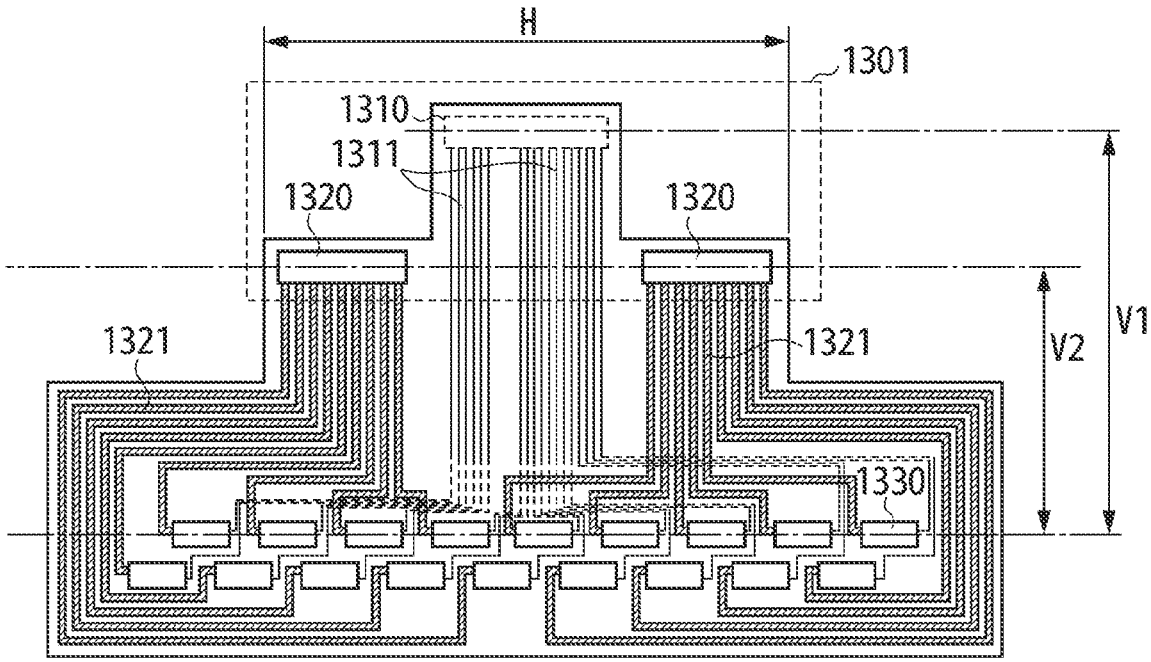
Figure 6A:
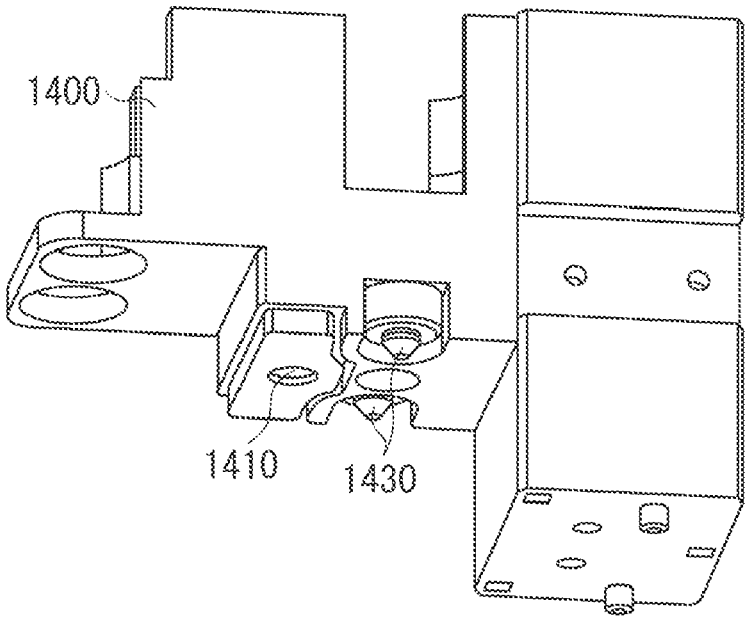
FIGS. 6A and 6B are general perspective views illustrating supporting members A and B.
Figure 6B:
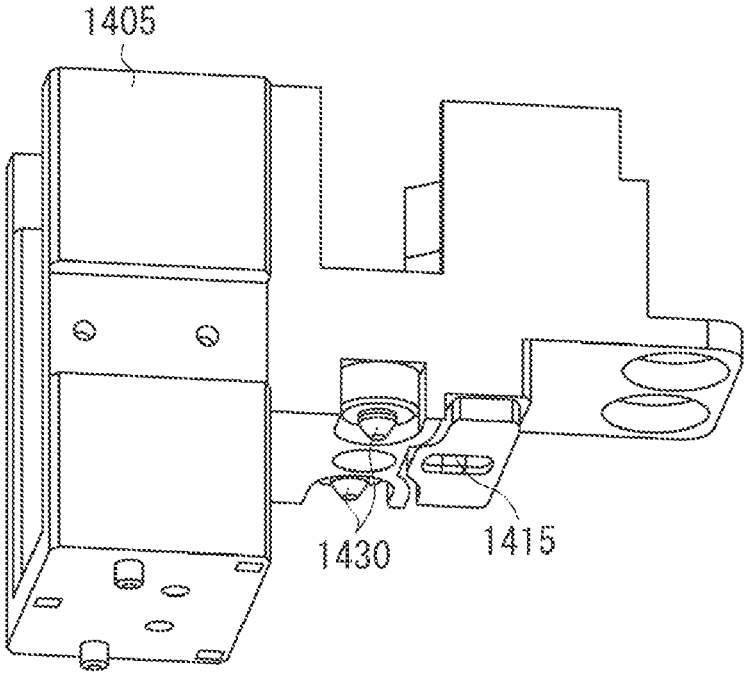

FIG. 5A is a perspective view of the electric wiring substrate 1300, and FIG. 5B is a view illustrated by transparent wiring to show a wiring layout of the electric wiring substrate 1300.

It becomes all the more preferable if in the signal wirings 1311 of the recording head 100, a length of wiring from each of the recording element substrates 1100 to the signal wiring connector 1310 becomes shorter, which reduces disturbances of waveforms of signals or influence of noises on the signals. Further, since a portion of the signals is subjected to differential transmission, it is necessary to perform wiring with equal lengths for each of the recording element substrates 1100. Hence, the signal wiring connector 1310 is arranged at a substantially central part of the electric wiring substrate 1300 in a disposed direction of the discharge ports 1105. Further, an interval V1 (see FIG. 5B) from the signal wiring connector 1310 to the opening portions 1330 is minimized, by providing the signal wiring connector 2110 on the driving circuit substrate 2100 side at a lower part of the driving circuit substrate 2100 (see FIG. 9). The signal wirings 1311 are routed to the signal wiring connector 1310 to pass through between a plurality of the opening portions 1330.

It is preferable that the power supply wirings 1321 exhibit a resistance as less as possible with respect to each of the recording element substrates 1100, and a resistance within a given range. As described above, the electric wiring substrate 1300 is configured such that the signal wiring connector 1310 is arranged at the central part in the disposed direction of the discharge ports 1105, in order to perform wiring of the signal wirings 1311 at equal lengths. With respect to the electric wiring substrate 1300, each of power supply wiring connectors 1320 is arranged on both sides, so that the signal wiring connector 1310 is provided between two power supply wiring connectors 1320 in a disposed direction. Further, widths of the power supply wirings 1321 are rendered as thick as possible, and the power supply wirings 1321 are routed to surround outer peripheries of a plurality of the opening portions 1330. The power supply wiring connectors 1320 are arranged so that a dimension H of the connector region 1301 in a disposed direction of the discharge ports 1105, and an interval V2 (see FIG. 5B for both) from the power supply wiring connectors 1320 to the opening portions 1330 become as small as possible. By rendering the dimension H of the connector region 1301 small, ink supply members 1500 can be arranged in a free space (see FIG. 1C), and a width in a longitudinal direction of the recording element unit 1000 can be rendered small.

As described above, the signal wiring connector 1310 and the power supply wiring connectors 1320 are provided separately, and the signal wirings 1311 and the power supply wirings 1321 to which a high voltage is applied, are separated. Accordingly, a region where the signal wirings 1311 and the power supply wirings 1321 come close to each other is small, and the signal wirings 1311 is less susceptible to noises generated by the power supply wirings 1321, than a case where the signal wirings 1311 and the power supply wirings 1321 are arranged to be mixed.

As illustrated in FIG. 1C, the connector region 1301 of the electric wiring substrate 1300 is bent in an "X" direction (see FIG. 9) in a portion of the electric wiring substrate 1300 disposed on a side surface of the base plate 1200, so that the connector region 1301 falls within a width with respect to a lateral direction of the recording head 100. With such a configuration, a risk that a width with respect to the lateral direction of the recording head 100 may become large due to the electric wiring substrate 1300, is avoided. Therefore, as illustrated in FIG. 10, when a plurality of the recording heads 100 is used side by side, an interval between the recording heads 100 is not restricted by the connector region 1301, and the interval can be arbitrarily set. By rendering the interval between the recording heads 100 small, a region where the recording sheet 3200 is provided in parallel with the recording heads 100, can be small. As a result, conveyance accuracy of the recording sheet can be improved and a risk of paper jam can be reduced, and a high quality recording becomes possible.

FIG. 9 is a perspective view illustrating a state where the recording element unit 1000 and the driving circuit substrate unit 2000 are combined with each other, and a state where a cover 2300 of the driving circuit substrate unit 2000 is removed. In the driving circuit substrate 2100, as illustrated in FIG. 9, the signal wiring connector 2140 and the power supply wiring connectors 2150 (fourth electrical contact group) for electrically connecting to the recording apparatus 3000 are arranged at uppermost part of the substrate in a gravity direction in a service state. In addition, the power supply wiring connectors 2120 (third electrical contact group) for electrically connecting the driving circuit substrate 2100 and the wire harnesses 2130, provided in the driving circuit substrate 2100, are arranged on the upper part of the substrate. A driving control circuit (not illustrated) is formed at a central part of the driving circuit substrate 2100, and the signal wiring connector 2110 is arranged at a lower part to the lowest possible point of the substrate. Further, a risk of interfering with parts such as an integrated circuit (IC) mounted on the driving circuit substrate 2100 can be reduced, by firmly fixing the wire harnesses 2130 to pass through side surfaces of the substrate holders 2200.

Since the signal wiring connector 2110 is arranged at a lower part of the driving circuit substrate 2100, the signal wirings 1311 of the electric wiring substrate 1300 can be made short. Also, the power supply wiring connectors 2120 and 2150 are provided to come close to each other at an upper part of the driving circuit substrate 2100, and the recording element unit 1000 and the driving circuit substrate 2100 are electrically connected via the wire harnesses 2130. Accordingly, the power supply wirings formed inside the driving circuit substrate 2100 can be made short, and a risk that the signal wirings may receive noises from the power supply wirings can be reduced.

In the present exemplary embodiment, three connectors (the signal wiring connector 1310, the power supply wiring connectors 1320) of the electric wiring substrate 1300 are provided so that each length component is brought into line with the disposed direction of a plurality of the discharge ports 1105. Also, the dimension H (see FIG. 5B) of the connector region 1301 in the disposed direction is made small, by making an interval between respective connectors small. Furthermore, the signal wiring connector 1310 and the power supply wiring connectors 1320 which are adjacent to each other, are mounted so as not to overlap each other in a disposed direction of the discharge ports 1105 and a direction orthogonal to the disposed direction. In the present exemplary embodiment, an interval from the power supply wiring connectors 1320 to the opening portions 1330 is shorter than an interval from the signal wiring connector 1310 to the opening portions 1330, and a shape of the connector region 1301 is convex.

In this way, in the connector region 1301 of the electric wiring substrate, the signal wiring connector 1310 and the power supply wiring connectors 1320 adjacent to each other are arranged not to overlap each other in the disposed direction of the discharge ports 1105 and a direction orthogonal to the disposed direction. More specifically, on both sides of the signal wiring connector 1310 in the disposed direction, the power supply wiring connectors 1320 are not provided. For this reason, in attaching/detaching the signal wiring connector 1310 to and from the driving circuit substrate 2100, a space necessary for attaching/detaching can be secured, and attaching/detaching job can be performed readily. Therefore, in order to fix a space for arranging the ink supply members 1500 or the like, even if a width of the connector region 1301 in the disposed direction of the discharge ports 1105 is made small, reduction of workability in attaching/detaching the connector can be suppressed. Since there are no members which cause obstacles to both sides of the signal wiring connector 1310, positioning of the signal wiring connector 1310 and the signal wiring connector 2110 on the driving circuit substrate 2100 side can be performed readily and surely.

On the other hand, also in the power supply wiring connectors 1320, the signal wiring connector 1310 is not disposed on both sides of the power supply wiring connectors 1320 in the disposed direction. Since the other sides facing them are the wire harnesses 2130 having flexibility, positioning and attaching/detaching job thereof are easy to perform. The electric wiring substrate 1300 is screw fixed to the wiring substrate fixing portion 1655 (wiring substrate fixing member). The fixing portion 1655 is formed integrally with the side plate assembly B 1650, in the proximity of the power supply wiring connectors 1320 (see FIG. 1C). Then, as described above, the side plate assembly B 1650 is fixed to two supporting members 1400 and 1405 of the recording element unit 1000 (see FIG. 9). Therefore, the electric wiring substrate 1300 is interconnected to the supporting members 1400 and 1405, via the side plate assembly B 1650. Further, the base plate 1200 is fixed to the two supporting members 1400 and 1405, at both ends in its longitudinal direction. For this reason, even if a force is applied at the time of attaching/detaching the power supply wiring connectors 1320, the supporting member 1400 receives the force, and accordingly a risk of deformation of the base plate 1200 can be reduced.

If the wire harnesses 2130 is not provided, it is also possible to form apart which substitutes for the wire harnesses 2130, integrally with the electric wiring substrate 1300. However, in this case, since the electric wiring substrate 1300 is extended to the power supply wiring connectors 2120 located at upper part of the driving circuit substrate 2100, the electric wiring substrate 1300 will be upsized. Accordingly, when the recording element unit 1000 is conveyed during an assembly job of the recording head 100, a risk arises that it becomes hard to deal with the electric wiring substrate 1300. Like the present exemplary embodiment, such a risk can be reduced by providing the wire harnesses 2130 as a separate component. Further, individual wiring can be formed thicker by using the wire harness than the wiring of flexible wiring substrate, and wiring resistance can be easily made small. Accordingly, the wire harness is preferable.

When the signal wirings 1311 are connected via separate member such as the wire harness, discontinuous locations of differential impedance increase, and there is a risk that signal quality deteriorates. For this reason, the signal wiring connector 1310 on the electric wiring substrate 1300 side, and the signal wiring connector 2110 on the driving circuit substrate 2100 side are directly connected. Therefore, a position at which the signal wiring connector 1310 is provided is dependent on a position at which the signal wiring connector 1310 on the driving circuit substrate 2100 side is provided. On the other hand, the power supply wirings 1321 can be connected via a separate member such as the wire harness. Thus, the power supply wiring connectors 1320 is provided so that an interval from the power supply wiring connectors 1320 to the opening portions 1330, becomes shorter than an interval from the signal wiring connector 1310 to the opening portions 1330. Accordingly, in the connector region 1301, a dimension in a lateral direction of the electric wiring substrate 1300 before fixed to the base plate 1200, can be made small.

The signal wiring connector 1310 on the electric wiring substrate 1300 side is inserted in an "X" direction in FIG. 9 relative to the signal wiring connector 2110 on the driving circuit substrate 2100 side. Also, the wire harnesses 2130 is plugged in a "−Z" direction relative to the power supply wiring connectors 1320 on the electric wiring substrate 1300 side. Since in such a way, attaching/detaching directions of adjacent connectors are different from each other (90-degree in the present exemplary embodiment), a risk is reduced that undue force may be applied to an adjacent connector portion, when connector is attached or detached.

In the present exemplary embodiment, different kinds of connectors are used for each type of wirings as the signal wiring connector 1310 and the power supply wiring connectors 1320 are provided. However, it is not necessary to provide different connectors for each type of the wirings, from viewpoint of workability at the time of attaching/detaching job. More specifically, when plural kinds of connectors are provided, it is only necessary that adjacent connectors are different from each other, in a disposed direction of the discharge ports 1105 and in a direction orthogonal to the disposed direction. Further, the power supply wiring connectors 1320 are provided in two locations according to the present embodiment, but both of them may be provided at one location. Furthermore, in the present exemplary embodiment, an interval from the opening portions 1330 to the power supply wiring connectors 1320 is shorter than an interval to the signal wiring connector 1310, but the present exemplary embodiment is not limited to this configuration from viewpoint of workability at the time of attaching/detaching job. In the present exemplary embodiment, the two power supply wiring connectors 1320 are provided to overlap each other in the disposed direction of the discharge ports 1105. However, in a case where a plurality of the power supply wiring connectors 1320 are provided, a position of the connectors is not limited to this, as long as a position does not impair attachability and detachability of the connectors. Further, a configuration of connector is not limited to the one as described in the exemplary embodiment, and may be optionally selected.

An electrical connection between the recording element unit 1000 and the driving circuit substrate unit 2000 is described according to the present exemplary embodiment. However, the present exemplary embodiment can be also applied to a case where the recording element unit 1000 is mounted directly to the recording apparatus 3000 to provide an electrical connection therebetween.

In the recording head 100 according to the present exemplary embodiment, a plurality of the recording element substrates 1100 are arrayed in a staggered pattern in the disposed direction of the discharge ports 1105, but a way of arraying the recording element substrates 1100 is not limited to any particular configuration. Further, the recording element substrate may be constituted by only one piece, instead of plural pieces.

As described above, according to the present invention, a dimension of the connector region of the electric wiring substrate in the disposed direction of the discharge ports can be made small, and the recording head with good workability at the time of attaching/detaching the connectors can be provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-112366 filed May 14, 2010, which is hereby incorporated by reference herein in its entirety.

What is claimed is:

1. A liquid discharge head comprising:

a recording element substrate having a plurality of discharge ports for discharging liquid, and a plurality of recording elements for generating energy to discharge liquid from the plurality of discharge ports; and an electric wiring substrate electrically connecting the recording element substrate and a driving circuit substrate having a circuit for driving the plurality of recording elements, the electric wiring substrate having a plurality of first electrical contact groups including a plurality of electrical contacts, for electrically connecting with the driving circuit substrate, provided along a disposed direction in which the plurality of discharge ports are disposed, wherein the plurality of first electrical contact groups are detachably attached to a plurality of second electrical contact groups electrically connected with the driving circuit substrate, such that adjacent first electrical contact groups of the plurality of first electrical contact groups, do not overlap each other in the disposed direction and in a direction orthogonal to the disposed direction.

2. A liquid discharge head according to claim 1, wherein the plurality of first electrical contact groups include an electrical contact group for signal in which a plurality of electrical contacts for signal supplying signals for driving the plurality of recording elements are disposed along the disposed direction, and an electrical contact group for power supply in which a plurality of electrical contacts for power supply supplying electric power for driving the plurality of the recording elements are disposed along the disposed direction.

3. A liquid discharge head according to claim 2, wherein the electrical contact group for signal is disposed roughly in the center of the electric wiring substrate in the disposed direction.

4. A liquid discharge head according to claim 3, wherein the electric wiring substrate has the two electrical contact groups for power supply, and wherein the electrical contact group for power supply, the electrical contact group for signal, and the electrical contact group for power supply are disposed in this order along the disposed direction.

5. A liquid discharge head according to claim 2, wherein the electric wiring substrate has internally opening portions for disposing the recording element substrate, and an interval between the electrical contact group for power supply and the opening portions is shorter than an interval between the electrical contact group for signal and the opening portions.

6. A liquid discharge head according to claim 2, wherein an direction when the electrical contact group for signal is attached or detached is different from an direction when the electrical contact group for power supply is attached or detached.

7. A liquid discharge head according to claim 2, wherein the electrical contact group for power supply is electrically connected to the driving circuit substrate via the electric wiring member which is separate from the driving circuit substrate, and wherein a third electrical contact group for electrically connecting with the electric wiring member, provided in the driving circuit substrate, is disposed closer than the electrical contact group for power supply to a fourth electrical contact group for electrically connecting with the outside of the driving circuit substrate, which is provided in the driving circuit substrate and electrically connected to the third electrical contact group.

8. A liquid discharge head according to claim 2, further comprising:

a base plate to be provided with the recording element substrate; and a supporting member connected to a liquid discharge apparatus on which the liquid discharge head is mounted and supporting the base plate, wherein the electric wiring substrate is coupled to the supporting member.

9. A liquid discharge head according to claim 8, further comprising:

a fixing member configured to fix the electric wiring substrate in proximity of the electrical contact group for power supply, wherein the electric wiring substrate is coupled to the supporting member via the fixing member.

10. A liquid discharge head according to claim 1, further comprising the driving circuit substrate.

11. An electric wiring substrate comprising:

an elongated opening portion for disposing a recording element substrate including a recording element for generating energy to discharge liquid; and a plurality of first electrical contact groups including a plurality of electrical contacts, for electrically connecting with a driving circuit substrate having a circuit for driving the recording element, provided along a longitudinal direction of the opening portion, wherein the plurality of first electrical contact groups are detachably attached to a plurality of second electrical contact groups electrically connected with the driving circuit substrate, and wherein adjacent first electrical contact groups of the plurality of first electrical contact groups are disposed so that they do not overlap each other in the longitudinal direction and a direction orthogonal to the longitudinal direction.

* * * * *